United States Patent [19]

Paoli

[11] 4,030,798

[45] June 21, 1977

[54] ELECTRICAL CONNECTOR WITH MEANS FOR MAINTAINING A CONNECTED CONDITION

[75] Inventor: Alfred Paoli, Chicago, Ill.

[73] Assignee: Akzona Incorporated, Asheville, N.C.

[22] Filed: Apr. 11, 1975

[21] Appl. No.: 567,273

[52] U.S. Cl. ..... 339/89 R; 151/13; 151/41; 285/85; 285/89; 339/DIG. 2

[51] Int. Cl.[2] ..... H01R 13/54

[58] Field of Search ..... 339/89, 90, DIG. 2; 151/13, 39, 41; 285/81, 84, 85, 86, 89, 92

[56] References Cited

UNITED STATES PATENTS

| | | | |
|---|---|---|---|
| 718,336 | 1/1903 | Freund | 151/13 |
| 957,504 | 5/1910 | Frenot | 151/41 |
| 1,011,871 | 12/1911 | Smoke | 151/13 |
| 3,517,371 | 6/1970 | Buckley | 339/89 C |
| 3,611,260 | 10/1971 | Colardeau | 339/89 R |

*Primary Examiner*—Roy Lake

*Assistant Examiner*—Mark S. Bicks

*Attorney, Agent, or Firm*—Hill, Gross, Simpson, Van Santen, Steadman, Chiara & Simpson

[57] ABSTRACT

An electrical connector has a coupling nut provided with ratchet teeth on one end thereof for cooperating with a spring, so that the coupling nut is harder to rotate in one direction than the other. The spring is formed as a leaf spring having an elongate arm which cooperates with the forward and rearward faces of the ratchet teeth extending from the coupling nut. The relation between the leaf spring and the ratchet teeth is such that any compressive force acting on the spring during turning of the coupling nut is relatively light, and so the spring does not buckle as the coupling nut is turned. In one embodiment, the spring is in tension during rotation of the coupling nut in its uncoupling direction, and in compression only during rotation of the coupling nut in its easy direction, when the force is light. In another embodiment, compressive forces during rotation in the uncoupling direction are minimized by a rounded surface on the spring.

3 Claims, 6 Drawing Figures

ELECTRICAL CONNECTOR WITH MEANS FOR MAINTAINING A CONNECTED CONDITION

BACKGROUND

1. Field of the Invention

The present invention relates to electrical connectors and more particularly to connectors which are provided with means for protecting against accidental de-coupling by vibration.

2. The Prior Art

Coupling mechanisms have been know in the art which are adapted to resist de-coupling as a result of vibration. Several different designs for such coupling nuts are illustrated and described in the copending application of Paoli et al, Ser. No. 303,339, filed Nov. 3, 1972, now U.S. Pat. No. 3,971,614 and assigned to the same assignee as this application. In one arrangement in particular, described in the aforesaid application, the mechanism for giving a differential resistance to rotation of the coupling nut in the forward and reverse directions comprises a leaf spring which bears against ratchet teeth formed on one end of the coupling nut, so that the leaf spring is cammed away from the coupling nut when the nut is turned in its easy (coupling) directon, but impedes rotation of the coupling nut in the other (uncoupling) direction.

While this structure operates quite satisfactorily, it is susceptible to the possibility of jamming if the leaf spring should buckle. Buckling could occur as the result of an unexpectedly large amount of friction between a ratchet tooth and the end of the leaf spring.

One approach to this problem is to make the leaf spring heavier and more rigid, and another is to take special steps to insure a smooth surface for the sides of the ratchet teeth. Either of these approaches involves greater cost, however, and it is therefore desirable to provide a less expensive alternative.

SUMMARY OF THE INVENTION

It is a principal object of the present invention to provide an improved differential force structure for an electrical connector which eliminates the aforesaid difficulties without any materially increased costs.

A more specific object of the present invention is to provide a means for preventing the possibility of buckling of the leaf spring in a differential force electrical connector, without the need for taking special steps which result in increased costs for such connector.

These and other objects and advantages of the present invention will become manifest by an examination of the following description and the accompanying drawings.

In one embodiment of the present invention there is provided an electrical connector having means for tending to resist rotation of the coupling nut in one direction more than in the other, comprising a leaf spring mounted on a shell of said connector and having an elongate arm having a hooked end for cooperating with ratchet teeth extending from an end of the coupling nut, so that the leaf spring is in compression while said nut is being turned in its easy (coupling) direction, but in tension when said nut is being turned in its other (uncoupling) direction. In another embodiment, the end of the spring is rounded, so as to minimize compressive forces.

BRIEF SUMMARY OF THE DRAWINGS

Reference will now be made to the accompanying drawings, in which.

Figure 1:
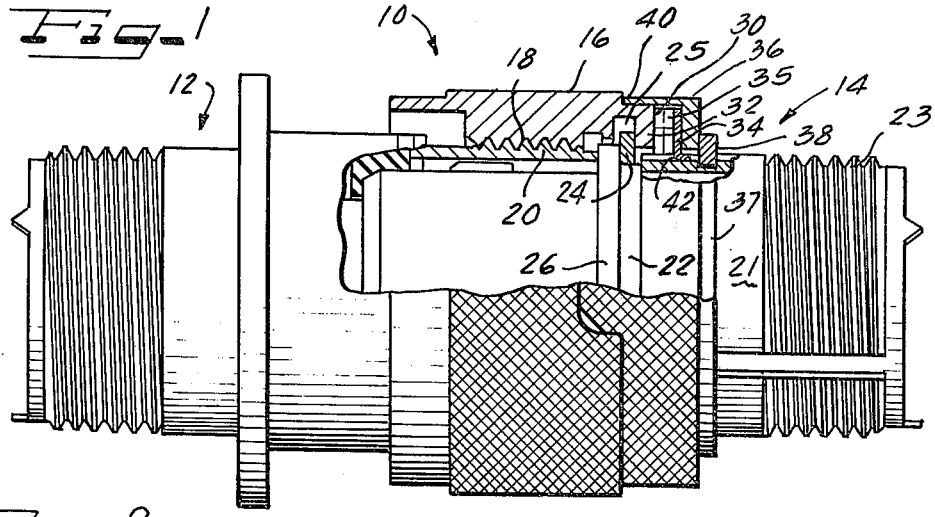
FIG. 1 is a side elevation, partly in cross section, of an illustrative embodiment of the present invention.

Referring first to FIG. 1, the electrical connector 10 incorporates two shells 12 and 14, which serve, respectively, as the plug shell and the receptacle shell of the electrical connector. As used hereinafter, the term "inner" will be used to identify the end of each shell closest to the other shell and the direction toward that end, while the term "outer" will be used to identify the opposite end and directon.

On the shell 14, a coupling nut 16 is mounted and is adapted freely to rotate relative to the shell 14. A series of inside threads 18 is provided on the coupling nut 16, and these threads cooperate with corresponding outside threads 20 which are located at the end of the shell 12. The shell 14 has a circular cylindrical surface 21, at the end of which external threads 23 are provided. The inner end of the surface 21 has a groove 22 in which is disposed a snap ring 24. The snap ring 24 is also partly located in a groove 25 provided in the inner periphery of the coupling nut 16. The coupling nut 16 is thus bound to the shell 14, but is freely rotatable thereon.

The groove 22 is bounded on its inner side by means of a flange 26, which extends radially outwardly beyond the cylindrical surface 21. The outer end of the coupling nut 16 and the outer side of the groove 25 are defined by a flange 30, which extends radially inwardly a distance beyond the inward extension of the threads 18, and beyond the outer periphery of the flange 26. In this manner, the coupling nut is positively held on to the shell 14 by the flange 26, even if the snap ring 24 is omitted from the assembly of the connector.

The inner end of the coupling nut 16 is provided with a series of outwardly extending projections 32, which take the form of ratchet teeth. A flat spring 34 is mounted on the shell 14 and is provided with a plurality of elongate arms 35, which are adapted to bear against the faces of the ratchet teeth 32. The cooperation of the arms 35 with the ratchet teeth is such as to make the coupling nut 16 harder to turn in its uncoupling direction than in the coupling direction. This insures that the connector is immune to vibration which otherwise would cause an undesired separation of the two connector shells 12 and 14.

A retainer 36 is provided on the outer side of the spring 34 and retains the spring 34 in position, urging it against the ratchet teeth 32. A snap ring 38 is disposed in a groove 37 on the shell 14 located at the outer side of the retainer 36.

The retainer 36 is preferably keyed to the coupling nut 16 by means of a key 40 received in a notch of the coupling nut, so that the coupling nut 16 and the retainer member 36 both rotate together. Both are provided with a knurled surface, so that rotation of either or both members can effectuate couple of a connector. The keying of the retainer member 36, together with the coupling nut 16 and the provision of the knurled surface on both of these members, allows the connector to be made in relatively small sizes, while still providing a large enough surface area of the knurled surface so that an operator may grip and turn the coupling nut to make a connection.

Figure 2:
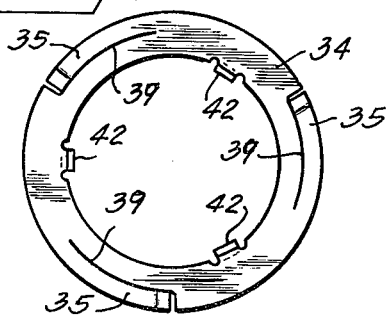
FIG. 2 is a plan view of a spring used in connection with the apparatus of FIG. 1.

In FIG. 2, a plan view of the spring 34 is illustrated in more detail. The spring 34 is formed from a circular disk of spring material, and three elongate arms 35 are separated from the main body of the spring 34, adjacent the outer periphery thereof, by arcuate slits 39. Adjacent the radially inner periphery of the spring 34, three tabs 42 extend radially inwardly slightly from the main body of the spring 34, with ends which are turned toward the inner end of the shell 14, so as to form tabs 42. The tabs 42 are retained in three grooves 44 provided in the shell 14. The grooves 44 (FIG. 3) extend from the outer end of the groove 22 to the outer end of the shell 14. During assembly of the connector, the spring 34 is slipped over the end of the shell 14, with tabs 42 sliding along the grooves 44. The tabs 42 remain in the grooves 44 when the spring 34 is slipped into its assembled position, and prevent the spring 34 from rotating relative to the shell 44.

Figure 3:
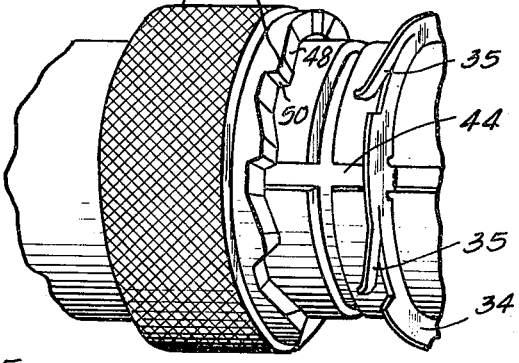
FIG. 3 is a perspective view of a portion of the apparatus of FIG. 1.

A plurality of the ratchet teeth 30 are disposed in equally spaced arrangement around the periphery of the outer end of the coupling nut 16 and, in the embodiment illustrated in FIG. 3, nine such teeth are shown.

Figure 4:
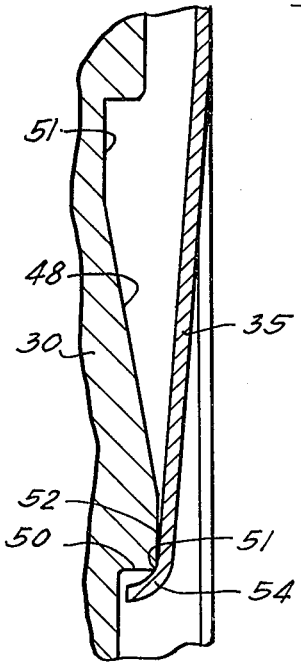
FIG. 4 is an enlarged cross sectional view of a portion of the coupling nut in association with a portion of the spring, illustrating a specific embodiment of the present invention.
Figure 5:
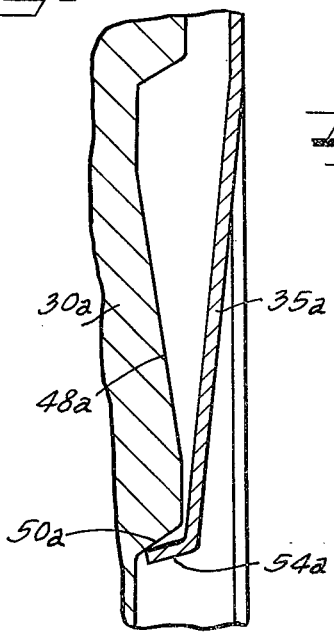
FIG. 5 is an illustration similar to FIG. 4, illustrating a second embodiment of the present invention.
Figure 6:
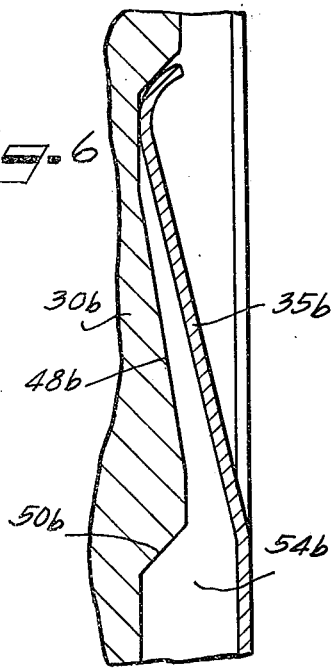
FIG. 6 is an illustration similar to FIGS. 4 and 5, illustrating a third embodiment of the present invention.

FIGS. 4, 5, and 6 illustrate three different arrangements of the teeth 30 and the arms 34 which may be used, showing an enlarged view of a portion of the outer end of the coupling nut 16 and one of the teeth 30 in association with an arm 35 of the spring 34. The tooth 30 is provided with a forward face 48 and a rearward face 50. Two relatively flat sections 51 and 52 separate adjacent forward and rearward faces of the teeth 30. The forward face 48 is inclined at a relatively small angle with respect to a plane normal to the axis of rotation of the coupling nut, while the rearward face 50 is inclined to a relatively steep angle with respect to such plane.

The arm 35 has a hooked end 54, with the hook extending toward the coupling nut so as to curl around the rearward face 50 of the coupling nut when the parts are in the relationship illustrated in FIG. 4.

When the coupling nut is turned in its forward (coupling) direction, the movement of the ratchet tooth 30 is upward, as shown in FIG. 4, so that the hooked end 54 of the arm 35 is cammed gently outwardly by the forward face 48, and slips beyond the end of the surface 52 down over the rearward face 50. The next ratchet tooth repeats the action. Because of the relatively shallow angle of the forward face 48, there is relatively little compressive force acting along the length of the arm 35, and there is little or no tendency for the arm 35 to buckle, even if there should be rough spots on the face 48.

When the coupling nut 16 is rotated in its reverse (uncoupling) direction, the movement of the ratchet tooth 30 is downward relative to the arm 35, as shown in FIG. 4, and the hooked end 54 of the arm 35, the inner or concave surface of which bears against the corner 51 between the faces 50 and 52, produces a considerable amount of resistance to rotation of the coupling nut. This corner may be considered part of the rearward face 50. Since the arm 35 is deformable and can be cammed away from the tooth 30, it does not prevent rotation of the coupling nut, but merely impedes it during reverse rotation. The amount of impediment to rotation of the coupling nut in the reverse direction is readily controlled by regulating the angle of the rear face 50 of the ratchet teeth 30 or by regulating the amount of curvature of the hooked end 54. Changing this curvature has a marked effect on resistance to uncoupling rotation, while leaving the slight resistance to coupling rotation unaffected.

FIG. 5 illustrated a modified structure, in which a ratchet tooth **30*a* cooperates with an arm 35*a*. The forward face 48*a* of the ratchet tooth 30*a* is similar to that as illustrated in FIG. 4, but the rearward face 50*a* is inclined at a different angle relative to a plane normal to the axis of rotation of the coupling nut. A straight finger 54*a* extends from the free end of the main portion of the arm 35*a* at an angle, toward the tooth 30*a*, and the end of the finger 54*a* bears against the tooth. The arm 35*a* and finger 54*a* illustrated in FIG. 5 are equivalent to that illustrated in FIG. 4 and may be referred to as an arm with a hooked end, the hook being straight rather than curved. It functions in the same manner to impede but not prevent rotation of the coupling nut in the reverse direction. Resistance to uncoupling rotation depends primarily, however, on the angle of the face 50*a*, and not as much on the angle of the finger 54*a***.

In the embodiments of both FIGS. 4 and 5, reverse rotation of the coupling nut does not tend to buckle the arms 35 and **35*a* because the force on such arms is in tension during reverse rotation; the compressive force acting along the length of the arm 35 or 35*a*** is extremely light during forward rotation of the coupling nut.

In FIG. 6 another alternative embodiment of the present invention is shown, in which the arm **35*b* of the spring member 34 extends in a direction opposite to that illustrated in FIGS. 4 and 5, relative to the ratchet tooth 30*b*. The end of the arm 35*b* is provided with an outwardly hooked or curved portion 54*b*, with the convex side of the hook being adapted to engage the forward surface 30*b* and the rearward surface 50*b* of the ratchet tooth 30*b*. Due to the convex curvature of the end 54*b*, it does not tend to bind on either the forward or rearward faces of the ratchet tooth, even if there are rough places on these surfaces. Accordingly, even though the arm 35*b* is in compression during the reverse rotation of the coupling nut, the hooked end 54*b* slides on the faces of the ratchet teeth 30*b*, and does not bind or buckle. The resistance to rotation of the coupling nut in its uncoupling direction is dependent primarily on the angle of the rearward faces 50*b***.

In the foregoing, embodiments of the present invention have been described in such detail as to enable others skilled in the art to make and use the same. It will be appreciated that various additions and modifications may be made without departing from the essential features of novelty of the present invention, which are intended to be defined and secured by the appended claims.

I claim:

1. An electrical connector comprising a plug shell, a receptacle shell, a coupling nut for interconnecting said shells, said coupling nut being mounted for rotation on one of said shells and having threads adapted to cooperate with corresponding threads on the other of said shells, said coupling nut having a plurality of ratchet teeth extending therefrom, said ratchet teeth each having a forward face and a rearward face formed at different angles relative to a plane normal to the axis of rotation of said coupling nut, and an elongate spring arm mounted on one of said shells and urged into contact with said ratchet teeth, said arm comprising an intermediate portion and a hooked free end terminal portion, said hooked terminal portion bearing against one of the forward and rearward faces of said ratchet teeth for impeding but not preventing rotation of said coupling nut in its uncoupling direction while maintaining rotation of said coupling nut in its coupling direction substantially unimpeded, said forward face being formed at a lower angle than said rearward face, relative to a plane normal to the axis of the coupling nut, and when said coupling nut is turned during coupling, said forward face moves, relative to the free end of said spring arm, in the direction which extends from the free end of said arm toward the other end of said arm, whereby frictional forces acting between said ratchet teeth and said arm places said arm in compression during coupling.

2. Apparatus according to claim 1, wherein said hook is formed by a straight terminal portion of said arm, joined to an end of a main portion of said arm.

3. Apparatus according to claim 1, wherein said hook is formed by an inwardly curved terminal portion of said arm.

* * * * *